United States Patent [19]

Goldhammer

[11] Patent Number: 4,615,490

[45] Date of Patent: Oct. 7, 1986

[54] SHREDDER OR MICROFILM DESTRUCTION APPARATUS

[75] Inventor: Albert Goldhammer, Überlingen, Fed. Rep. of Germany

[73] Assignee: Firma Feinwerktechnik Schleicher & Co., Markdoff, Fed. Rep. of Germany

[21] Appl. No.: 674,273

[22] Filed: Nov. 23, 1984

Related U.S. Application Data

[63] Continuation of Ser. No. 362,677, Mar. 29, 1982, abandoned.

[30] Foreign Application Priority Data

Mar. 31, 1981 [DE] Fed. Rep. of Germany ..... 3112667

[51] Int. Cl.[4] ..... B02C 18/18

[52] U.S. Cl. ..... 241/36; 241/222; 241/241; 241/243

[58] Field of Search ..... 241/32, 33, 36, 222–225, 241/235, 236, 241, 242, 243, 57, 60

[56] References Cited

U.S. PATENT DOCUMENTS 4,034,422 7/1977 Färber et al. ..... 241/36
4,134,552 1/1979 Fraser et al. ..... 241/36
4,198,799 4/1980 McGrath ..... 241/79.1 X
4,355,766 10/1982 Wigand ..... 241/222

*Primary Examiner*—Mark Rosenbaum
*Assistant Examiner*—Timothy V. Eley
*Attorney, Agent, or Firm*—Lackenbach Siegel Marzullo Presta & Aronson

[57] ABSTRACT

A microfilm destructing apparatus with a case and with a feed shaft disposed at the case for feeding of one or possibly more film cards along a cutter plate to a rotating milling cutter, which disintegrates the film card into fine particles; and which a complete and interference free removal of the generated microfilm particles is assured. The exhaust shaft is connected near the output end of the milling cutter, and is also connected to a suction blower. An air stream passes through the air gap slot, which is formed between the milling cutter teeth and the tip of the cutter plate. A pressure air stream may be employed fed from the input side to the milling cutter or if a suction air stream is present, it functions at the output end of the milling cutter. It is preferred if the exhaust shaft is disposed in immediate proximity, that is, in the direction of the stream, behind the milling cutter, such that the sucked off particles pass with as favorable a flow pattern as possible in free fall into the exhaust shaft.

5 Claims, 5 Drawing Figures

Figure 3:
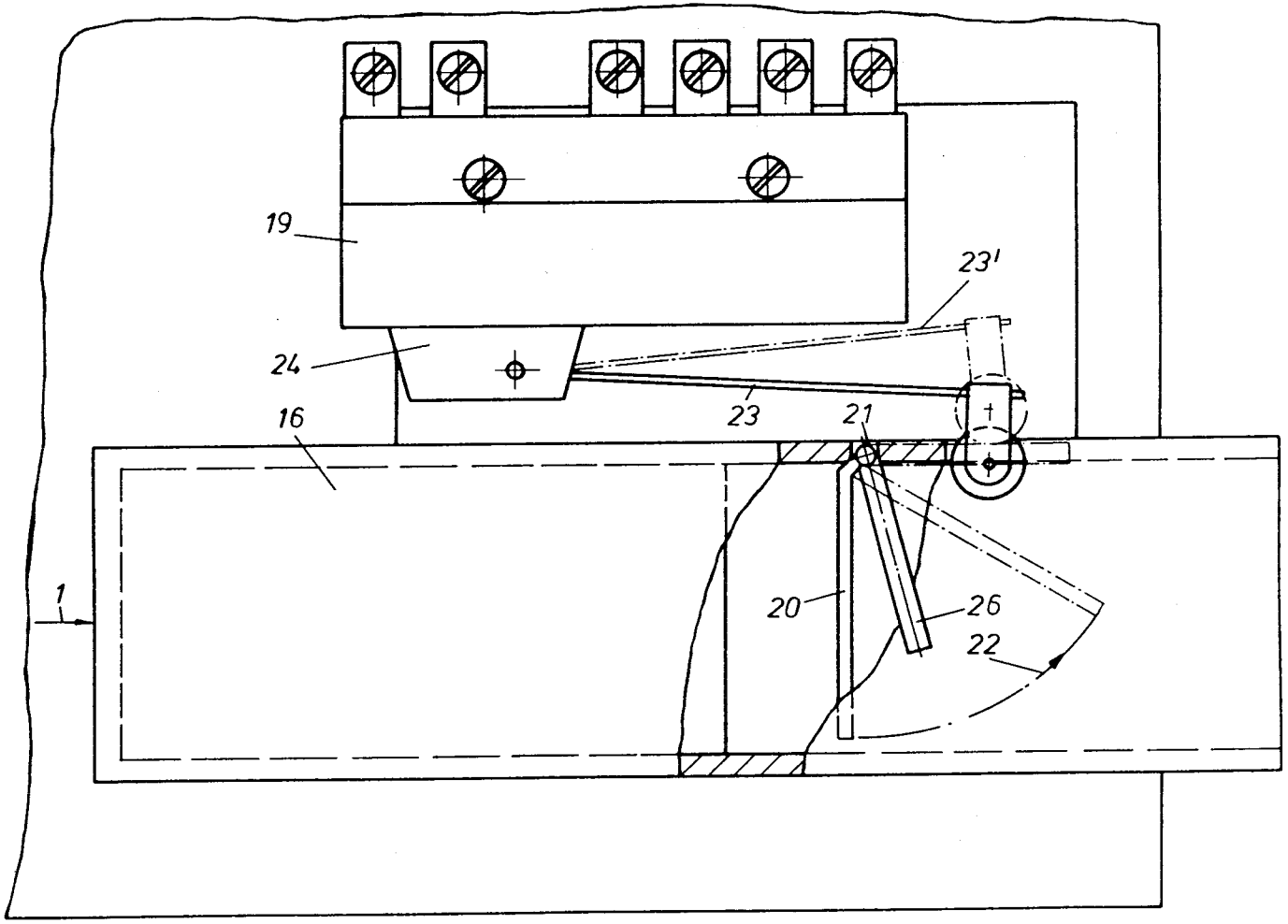

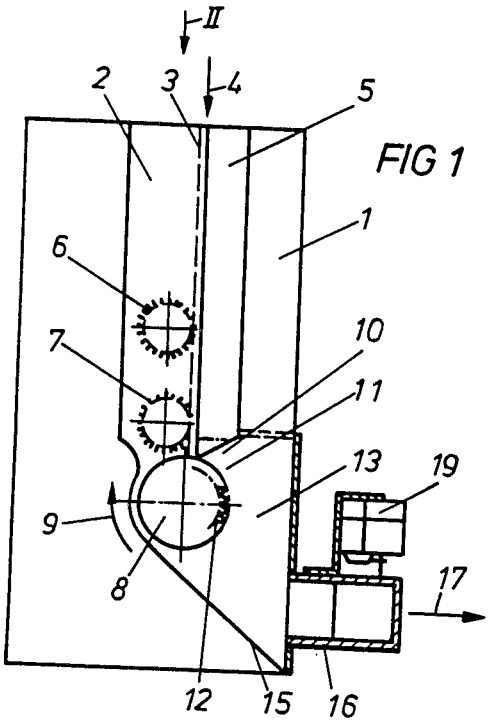
FIG 1
FIG 4
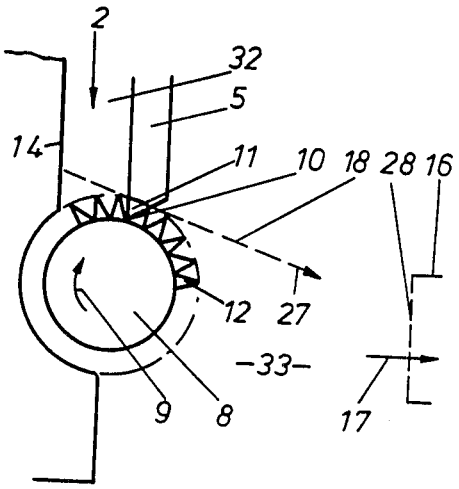
FIG 2
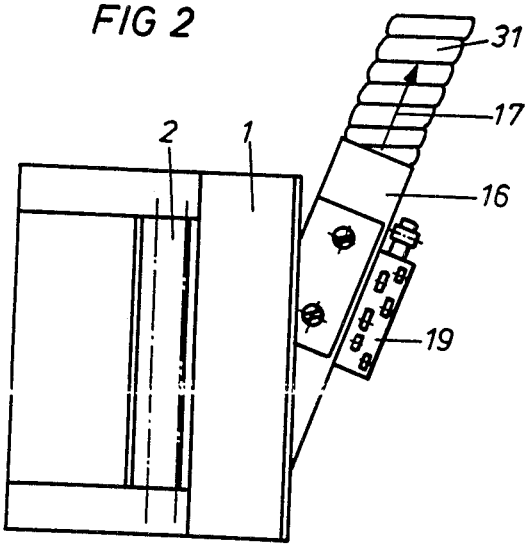
FIG 5
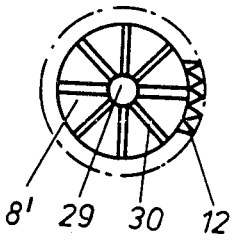

SHREDDER OR MICROFILM DESTRUCTION APPARATUS

This is a continuation of application Ser. No. 362,677, now abandoned, filed Mar. 29, 1982.

The subject matter of the invention is a microfilm destruction apparatus in a case and with a feed shaft disposed at the case for guiding one and possibly more film cards along a cutter plate to a rotary milling cutter, which disintegrates the film card into fine particles.

The presently known microfilm destruction apparatus are based on the principle that a stack of microfiches is fed to a milling cutter via a feed device. The milling cutter cuts the one or at most two fed in microfiches beginning from the lower front face away toward the upper side, whereby particles of a fine like dust are generated.

One disadvantage is that high static charges were generated based on the cutting process and the elongations of the plastic material connected there with and the thereby occurring temperatures of about above 80 degrees centigrade. These static charges led to the situation that these particles deposited at the lower casing part in a collector shaft or collector container baked together by way of the static charge to such an extent that they led to a stopping up of the apparatus. These particles could not be removed again from the apparatus.

There existed another disadvantage in that the fine like dust particles were immediately blown into the environment upon the occurrence of an air draft such as for example at the opening or closing of the door of the collector container, and the particles were deposited all over and left a variety of disturbances in the electronics and in the drive of the microfilm destruction apparatus.

The present invention has the object to provide a substantially more reliably operating microfilm destruction apparatus of the kind initially recited, and in fact in the sense that a complete and undisturbed removal of the generated microfilm particles is assured.

In order to achieve the object of the invention, the mouth of a suction shaft or channel near the output end of the milling cutter is connected to a suction fan.

It is also essential according to the present invention that an air stream is pulled through the air gap, which is formed between the milling cutter teeth and the tip of the cutting plate. It is in this context unimportant, if it is referred to as an pressure air stream fed in from the input side of the milling cutter or to a suction stream functioning at the output end of the milling cutter.

Therefor, it is an essential feature of the present invention, that the complete milling cutter and in particular the air gap between the cutter plate and the milling cutter is disposed in the air stream of a suction fan and that the microfilm particles generated during the cutting process are sucked up directly by the suction fan via an exhaust shaft.

It is preferred in this connection if the exhaust shaft is disposed in the immediate vicinity, that is in the flow direction, after the milling cutter, such that the sucked off particles pass with a flow pattern as favorable as possible in free fall into the exhaust shaft.

Surprisingly, it has been found that there is no longer any electrostatic charges of the microfilm particles at all which can be determined. The reason may be that the generated air stream between the milling cutter and the tip of the cutter plate reduces the previously given temperature from 80 degrees centigrade to about 30 degrees centigrade and thereby the charge generating effects in the plastic foil are avoided, which are based on high temperatures. It has also been found that the immediate sucking off of the microfilm particles avoids a touching of the case, and apparently this touching of the case has led in the past to the electrostatic charging.

Based on a low temperature, the milling cut becomes very exact, since the material is heated only to a temperature of 30 degrees centigrade, and no loading or loading effect of the plastic material results at the cutter teeth of the milling cutter.

A further substantial feature is that the teeth of the milling cutter also operate like a kind of turbine, since the slot between the cutter plate and the surface of the teeth of the milling cutter has the value zero. This means that the slot is generated by moving the milling cutter upward or by pressing the plate against the milling cutter until the milling cutter has cut a corresponding profile shape into the cutter plate.

The cutter plate is then fixed in this position and thus a zero air gap results between the plate and the milling cutter.

Thus, the milling cutter thereby operates with its teeth like a kind of free jet turbine, since each tooth with its behind lying intermediate space takes with it an air stream from above and this air stream is fed immediately into the blower by the below disposed suction fan, whereby the particles are immediately entered into the air stream of the suction fan and are sucked off.

In the Drawings

FIG. 1 is a schematic side view of a microfilm destructing apparatus made according to the invention;

FIG. 2 the plan view on the microfilm destructing apparatus looking in the direction of the arrow II in FIG. 1;

FIG. 3 a sectional representation of the exhaust shaft with a switch disposed therein for a level dependent control of the suction;

FIG. 4 a principal representation of the cutting process; and

FIG. 5 a second embodiment of a milling cutter with compressed air feed.

A feed shaft 2 is provided in a case 1 according to FIG. 1. The film 3 or the film card is fed in from above in the direction of the arrow 4 and is run about parallel to the cutting plate 5 at a first spiked feed roller 6 and caught by the spiked feed roller and fed downward. It enters into the region of a second spiked feed roller 7 where it is fed to the milling cutter 8, which rotates in the direction of the arrow 9. An air gap 11 with the value zero is disposed between the milling cutter 8 and the tip 10 of the cutter plate 5. The cutting teeth 12 of the milling cutter 8 thus reach the previously described effect of a free jet turbine.

The fed-in film 3 is disintegrated or cut up into small particles 13 fine as dust at the surface of the milling cutter teeth, which previously according to the provisions of the state of the art (without suction fan) would have deposited in the shape of a heap brimful at the lower side of a collector container 15.

Instead, the microfilm particles which are as fine as dust are fed away in the suction direction 17 via the exhaust shaft 16 by a suction fan not shown in detail.

FIG. 2 shows the complete apparatus from above with the feed shaft 2 and the case 1 from above as well as the side shaft 16, where the microfilm particles are sucked up in the suction direction 17. The suction is provided by a high power suction blower, the suction tube 31 of which is connected at the indicated point.

There is further present a filling level control and a device for switching off according to the filling level, which are described hereinafter with reference to FIG. 3.

A switching case 19 is provided, which is attached to the exhaust shaft 16. An oscillating flap 20 is disposed in the air stream of the exhaust shaft, which is disposed tiltable around a hinge point 21.

The oscillating flap 20 is tilted upward in the direction of arrow 22 by switching on of the suction blower and the oscillating flap thereby comes to rest at the sensing lever 23, which actuates a microswitch 24 in order to release or switch off the complete electric circuitry. If the filling container (not shown here in detail) of the suction fan is filled, then the suction power decreases such that the sensing lever is tilted from its turned-on position (dash-dotted with 23' represented in FIG. 3) into the position according to numeral 23 in the direction of arrow 22 and actuates the microswitch 24.

Thereby immediately the drive of the suction fan and the drive of the film destructing apparatus are switched off and a corresponding warning light lights up, which indicates that the container has to be emptied.

The oscillating flap 20 is shown in two stages in FIG. 3. It comprises a flap part disposed in the air stream and an actuation lever 26, which then positively locking by engages the sensing lever 23 and actuates the same.

It is important that just the opening of the suction fan or of the exhaust shaft is disposed immediately about the tangential in the direction of the line 18 between the edge of the cutter plate and the coordinated, oppositely disposed edge of the milling cutter 8, such that the tangentially flying out microfilm particles pass immediately into the exhaust shaft 16.

The principle relations are again illustrated by way of FIG. 4.

An improved suction power is achieved if the milling cutter 8 is at least in part surrounded by a shielding plate 14 such that two areas of different pressures are generated by way of the shielding plate illustrated and by way of the disposition of the cutting plate 5 with the air gap 11. The feed end 32 for the film 3 is thereby subjected to a higher pressure as compared with the output end 3, such that the particles 13 generated by the milling cutter 8 fly about in the direction of the tangent 18 (throw direction 27) to the mouth 28 of the exhaust shaft 16. It becomes also clear from the illustration that the milling cutter teeth, which are provided with a saw tooth profile inclined in the rotation direction 9 in a way known in principle, achieve the effect of a free jet turbine in sense of an air transport in the air gap slot 11 of the tip 10 of the cutter plate 5, whereby the transport effect of the particles is improved in the direction toward the exhaust shaft 16.

FIG. 5 shows a further embodiment of a milling cutter 8', which is provided with an axial bore 29 from which start radial bores 30 distributed over the circumference and being equidistant, which bores end between the milling cutter teeth 12 of the milling cutter. If now an air stream is fed to the axial bore 29, then a still stronger effect in the sense of a throw effect in the throw direction 27 is achieved at the output end 3 of the milling cutter 8', whereby the suction power can be still substantially improved.

The milling cutter 8' can be employed without the suction provision. However, it can also be employed in connection with the suction described by way of FIGS. 1 to 4.

It is further essential that the suction power is very large, thus no regular vacuum cleaner can be employed, since it is assumed that the suction power is higher than the electrostatic force between the particles 13 baking together, and that thereby the baking together effect is avoided. In the same vein, there is a further explanation that a certain deionizing effect is achieved by way of the afterward sucked in air.

I claim:

1. A shredder apparatus for cutting materials such as microfilm comprising:

a housing;

rotary cutting means having an inlet and an outlet for cutting said material into small particles;

feeding means comprising a plurality of spiked feed rollers for feeding said material to the inlet of the cutting means along a path parallel to a cutting plate separating said inlet from said outlet of said cutting means;

drive means for said cutting means and for said spiked feeding means;

a suction channel means in a form of a hose having a mouth which is disposed near said outlet of said cutting means;

a suction fan connected to said suction channel means to pull in said particles which are generated by said cutting means shredding said material;

flow sensing means provided in said hose of said suction channel means responsive to the air stream therein; and switching means automatically stopping and shutting down said drive means in response to said suction power;

said switching means being operated by said sensing means to stop said drive means if the suction power decreases to a predetermined value; whereby the shredding of said microfilm is stopped not only should said outlet be full, but also should other inherently obvious defects occur in said apparatus, such as an inoperative suction fan or a leak in said suction hose;

said cutting means being a rotatable milling-like cutter which runs in the work direction through an air gap at a tip of said cutter plate disposed against said cutter such that the distance between the tip of said cutter teeth to the tip of said cutter plate approaches a substantially zero value.

2. The shredder apparatus according to claim 1, wherein said rotatable cutter has a plurality of teeth having a saw tooth profile which runs in the work direction through said air gap, said cutting teeth being adapted to jet along with cut microfilm particles being emitted from said air gap along with cur microfilm particles being emitted from said air gap toward said suction channel, whereby said microfilm particles are cooled from heat generated from being cut by said cutter teeth and a lower pressure area is created on the suction side of said air gap than on the intake side of said air gap so that said microfilm particles are inhibited from being deposited at the bottom of said housing.

3. The shredder apparatus according to claim 2, including a case, a feed shaft disposed in said housing for feeding of one or more film cards along a cutter plate to said rotary milling cutter, which disintegrates the film card or cards into a plurality of fine particles, characterized in that a particle carrying air stream is provided in said air gap of the cutter plate by means of an axially bored aperture through the shaft of said milling cutter and by means of radial bores from the axial bore of said shaft in the direction toward the milling cutter teeth.

4. The shredder apparatus according to claim 2, characterized in that said milling cutter is surrounded at least in part by a shielding plate such that two areas of different pressures are generated by way of said shielding plate and by way of the disposition of said cutting plate with said air gap, namely first and second pressure areas, said first pressure area being on the intake side of said cutter teeth and said air gap and said second pressure area being on the suction side of said cutter teeth and said air gap, wherein said lower pressure area on said suction side of said air gap is maintained.

5. The shredder apparatus according to claim 1, wherein said sensing means is a pivotable flap in the suction channel means acting on a lever of a microswitch for switching the electrical circuit of said apparatus from an on to an off position as is required when it is time to remove a full load of particles of said apparatus.

* * * * *